United States Patent [19]

Chow

[11] Patent Number: 4,978,070

[45] Date of Patent: Dec. 18, 1990

[54] PULSATING SPRINKLER

[75] Inventor: Ho Chow, Cliffside Park, N.J.

[73] Assignee: Hunter-melnor, Inc., Moonachie, N.J.

[21] Appl. No.: 392,737

[22] Filed: Aug. 11, 1989

[51] Int. Cl.[5] ..... B05B 3/04

[52] U.S. Cl. ..... 239/230; 239/231; 239/511; 239/513

[58] Field of Search ..... 239/230, 231, 233, 511, 239/513, 232

[56] References Cited

U.S. PATENT DOCUMENTS

| | | | |
|---|---|---|---|
| D. 270,178 | 8/1983 | Heck . | |
| D. 276,454 | 11/1984 | Brown et al. . | |
| D. 287,267 | 12/1986 | Premo et al. . | |
| 2,214,990 | 9/1940 | Buckner . | |
| 2,309,782 | 2/1943 | Orr . | |
| 2,310,796 | 2/1943 | Lappin | 239/231 |
| 2,380,101 | 7/1945 | Englehart . | |
| 2,606,789 | 8/1952 | Royer . | |
| 2,625,411 | 1/1953 | Unger . | |
| 2,654,635 | 10/1953 | Lazzarini . | |
| 2,710,226 | 6/1955 | Izchaki . | |
| 2,757,046 | 7/1956 | Holmes . | |
| 2,793,911 | 5/1957 | Dudley . | |
| 2,946,517 | 7/1960 | Jacoby . | |
| 2,981,482 | 4/1961 | Warren . | |
| 3,009,650 | 11/1961 | Alvarez . | |
| 3,022,012 | 2/1962 | Sharp et al. . | |
| 3,063,645 | 11/1962 | Tropeano et al. . | |
| 3,070,314 | 12/1962 | Warren . | |
| 3,208,672 | 9/1965 | Sully . | |
| 3,408,009 | 10/1968 | Friedmann et al. . | |
| 3,434,665 | 3/1969 | Royer . | |
| 3,468,485 | 9/1969 | Sully . | |
| 3,543,013 | 11/1970 | Lockwood . | |
| 3,580,507 | 5/1971 | Beamer | 239/233 |
| 3,581,994 | 6/1971 | Heiberger . | |
| 3,721,388 | 3/1973 | Green . | |
| 3,726,479 | 4/1973 | Leissner et al. . | |
| 3,764,073 | 10/1973 | Costa et al. . | |
| 3,806,034 | 4/1974 | Purtell . | |
| 3,831,853 | 8/1974 | Drori . | |
| 3,912,171 | 10/1975 | Johnson . | |
| 3,930,617 | 1/1976 | Dunmire . | |
| 3,955,762 | 5/1976 | Cassimatis et al. . | |
| 3,957,205 | 5/1976 | Costa . | |
| 3,968,934 | 7/1976 | Healy . | |
| 3,977,610 | 8/1976 | Royer | 239/230 |
| 4,033,510 | 7/1977 | Jennison et al. . | |
| 4,055,304 | 10/1977 | Munson . | |
| 4,164,324 | 8/1979 | Bruninga . | |
| 4,182,494 | 1/1980 | Wichman et al. . | |
| 4,195,782 | 4/1980 | Troup . | |
| 4,205,787 | 6/1980 | Bruninga . | |
| 4,216,913 | 8/1980 | Troup . | |
| 4,231,522 | 11/1980 | Drechsel | 239/233 |
| 4,330,087 | 5/1982 | Wood et al. . | |
| 4,333,610 | 6/1982 | Clements . | |
| 4,402,460 | 9/1983 | Shavit et al. | 239/230 |
| 4,457,470 | 7/1984 | Hauger et al. . | |
| 4,497,441 | 2/1985 | Chow | 239/230 |
| 4,565,323 | 1/1986 | Berkan . | |
| 4,632,312 | 12/1986 | Premo et al. | 239/230 |

FOREIGN PATENT DOCUMENTS

| | | | |
|---|---|---|---|
| 153393 | 7/1952 | Australia | 239/230 |
| 97985 | 1/1984 | European Pat. Off. | 239/231 |
| 294859 | 12/1988 | European Pat. Off. | 239/231 |
| 2829084 | 4/1979 | Fed. Rep. of Germany | 239/233 |

*Primary Examiner*—Andres Kashnikow

*Assistant Examiner*—Michael J. Forman

*Attorney, Agent, or Firm*—Heiskell, Donelson, Bearman, Adams, Williams & Kirsch

[57] ABSTRACT

A pulsating sprinkler incorporating a three-position trip mechanism facilitating forward/reverse rotation and continuous rotation. The trip mechanism includes a trigger for reversing direction of rotation of the sprinkler, a latch for engaging an impact arm, and a control arm for maintaining the trigger in a fixed position. The trigger, latch and control arm are joined to a common pivot on the sprinkler body. A multiple position diffuser and deflector lever is adjustable for various degrees of diffusion or deflection of a water stream. The sprinkler body is easily removed from the bushing assembly by compression of snap fingers located at a terminal end of the spring body. Further, an O-ring radially seals a space between the bushing assembly and the sprinkler body. An impact arm having two plates with separated vanes extending between the plates or an impact arm with a single plate with two downwardly projecting vanes may be used for ease in molding and increasing manufacturing efficiency.

15 Claims, 4 Drawing Sheets

PULSATING SPRINKLER

FIELD OF THE INVENTION

The present invention relates to water sprinklers, and, more particularly, to water sprinklers which utilize an oscillating mechanism driven by the jet of water which issues from the sprinkler.

BACKGROUND OF THE INVENTION

Step-by-step rotary or pulsating sprinklers of the impact type employ an impact arm mounted for oscillating movement about a vertical axis. The impact arm includes a drive spoon, which in an impact limiting position is disposed in a position to be engaged by the fluid stream issuing from the outlet nozzle of the sprinkler. The drive spoon includes an initial pull-in surface which engages the stream and, by virtue of such engagement, creates a reaction component in a direction to move the drive spoon further into the stream and away from the impact limiting position. The initial pull-in surface of the drive spoon serves to direct the stream engaging the same on to a spaced reactant surface which establishes a reactant force outwardly of the axis having a tangential component capable of effecting movement of the impact arm in a direction away from the impact limiting position.

As the impact arm moves away, a helical torsion spring acting between the impact arm and the sprinkler body serves to retard the movement and effect a return movement of the impact arm to the impact-limiting position. When the impact arm reaches the impact limiting position with the drive spoon back in the stream, the arm impacts the rotatable sprinkler body so as to impart an arcuate movement to the sprinkler body mounted upright on the pivotal axis. In this way a relatively slow arcuate step-by-step movement is automatically cyclically imparted to the sprinkler body.

The trip mechanism used to automatically reverse the direction of rotation of a partial circle pulsating sprinkler typically includes latch means for interacting with the impact arm, trigger means for interacting with the sector stop (defining the limits of rotation) and a trip spring connecting the latch and trigger means. The ends of the trip spring are typically secured, one to the latch means and one end to the trigger means.

In a partial circle pulsating sprinkler, the sprinkler slowly rotates in a step-by-step mode through the desired arc of rotation defined by the sector stops, the slowness of the rotation enabling the full potential range of the spray to be achieved. When the trigger means of the trip means encounters the sector stop at the end of the arc, the trigger means is moved, the trip mechanism is tripped, and the latch means is displaced so as to cause a rapid step-by-step counter-rotation by the sprinkler body back to the extreme other end of the arc. There the interaction of the trigger means with the other sector stop again trips the trip mechanism and reverses the rotation of the sprinkler body back to the desired direction of slow rotation. When it is desired to operate a partial circle sprinkler in a full circle mode of operation, a portion of the trigger means is simply folded out of the way so that the trigger means either does not contact the sector stops or at least does not contact them in such a way as to cause tripping of the trip means.

In my earlier U.S. Pat. No. 4,497,441, a part circle step-by-step sprinkler is disclosed comprising a member adapted for connection to a fluid source and having a circumferential portion defining radially outwardly projecting ridges. A sprinkler body is mounted on the member and rotatable relative thereto in either direction, the sprinkler carrying nozzle means. Trip means are disposed on the sprinkler body and adapted to reverse the direction of rotation thereof when tripped, and a pair of manually adjustable sector stops are mounted on a circumferential portion of the member for hindered rotation with respect thereto, each sector stop being adapted upon engagement by the trip means to trip the trip means. Each of the sector stops extends about the member circumferential portion and has a tab projecting radially outwardly therefrom to enable manual movement of the sector stop in either direction, a radially inwardly projecting detent in meshing engagement with the member ridges, and biasing means for urging the sector stop detent against the member circumferential portion.

Each sector stop extends about a total circumference of the member circumferential portion, and each sector stop has a single such radially outwardly projecting tab. Each of the sector stops is preferably of a generally annular configuration with an inner ring, an outer ring, and means connecting the inner and outer ring along a narrow sector. The tab, the connecting means and the detent are optimally radially aligned in succession. Each inner ring is resiliently flexible and flattened at a sector diametrically opposite the sector stop detent to bias the detent against the member ridges.

The sprinkler may additionally comprise sealing means disposed intermediate the bottom of the member and the sprinkler body, the sprinkler body having a tapered portion adjacent the top of the member and a radially projecting flange adjacent the bottom of the member. The pressure of the water from a water source forces the sealing means against the bottom of the member to seal a space between the member and the sprinkler body. The outer ring of one of the sector stops, preferably the upper sector stop has resiliently flexible lugs extending upwardly from the top thereof into the sprinkler body tapered portion, thereby biasing the member downwardly towards the sprinkler body flange and against the sealing means.

The trip means include a trigger means and is tripped by movement of the trigger means. The trigger means has a body and an extension thereof, the trigger extension being manually movable between a limited sector sprinkler position in which the trigger extension extends into the operative planes of the tabs of both of the sector stops for tripping engagement therewith and a full circle sprinkle position in which the trigger extension is spaced from the operating planes of the tabs of both of the sector stops to preclude tripping engagement therewith. The sector stops are preferably vertically aligned. When the trigger extension is in a full circle sprinkle position it is disposed above the operative plane of the tabs.

In U.S. Pat. No. 4,632,312 to Premo et al. an impact drive sprinkler is disclosed. The sprinkler includes a unitary sprinkler body having a lower riser tube rotatably supported within a one piece bearing sleeve adapted for connection to a water supply riser, wherein the lower rise tube is joined to an upper range tube through which an irrigation water stream is projected. An oscillatory impact drive arm and a spring are mounted onto the sprinkler body for spring loaded rotation of the drive arm toward a position with a deflector spoon unit thereon interrupting the projected water stream. A one-piece reversing mechanism is also mounted onto the sprinkler body for shifting movement between forward- and reverse-drive positions, with a pair of integral spring arms thereon cooperating with cam surfaces on the sprinkler body to releasably retain the reversing mechanism in the desired position. The sprinkler further includes a combination diffuser and range deflector which are alternately usable and adjustable to select a droplet size and range of the projected water stream.

In U.S. Pat. No. 4,497,441, a three component assembly is required for reversing the direction of rotation of the pulsating sprinkler, whereas in U.S. Pat. No. 4,632,312, a reversing mechanism includes a pair of spring arms which cooperate with appropriate cam surfaces so that when a reversing trigger is in one of its operative positions, one of the spring arms is stressed and the other is unstressed, and when the reversing trigger is in its other operative position, the spring arms reverse their stressed and unstressed conditions respectively. These patents, therefore, disclose mechanisms for the reversal of a pulsating jet of water from a sprinkler which are quite involved.

Further, U.S. Pat. No. 4,632,312 includes a water stream diffuser and range deflector movably mounted on the sprinkler body for independent adjustment of droplet size and projected range of the water stream projected from a range tube. The diffuser assembly is moved axially to vary the degree of stream diffusion produced by the diffuser pin. The diffuser assembly can be rotated about the axis of its mounting cylinder so as to move the deflector plate into and out of the spray stream. Thus, two adjustments are accomplished independently of one another for a desired degree of diffusion and stream deflection, without one being dependent upon the other.

SUMMARY OF THE INVENTION

It is therefore an object of the present invention to overcome the disadvantages of prior impact drive pulsating sprinklers.

By the present invention a sprinkler body is rotatably mounted within a bushing assembly. An impact arm is rotatably mounted on the sprinkler body with a torsion spring interposed between the impact arm and the sprinkler body. A three position reversing trigger is movable between a forward-drive position, a reverse-drive position and a continuous rotation position. A single spring arm integral with the reversing trigger provides control for the operational position of the trigger.

In one embodiment, the reversing trigger is secured in each of its operative positions by the action of the single integral spring arm which is frictionally biased into detents when the trigger is in each of its operative positions. In an alternate embodiment, the single spring arm, integral with the reversing trigger, is frictionally held in position during reversal between the forward-drive position and the reverse-drive position.

In each embodiment, a spring arm is commonly mounted with a trigger onto a pivoting hub. The sprinkler is operated by positioning of the reversing trigger. The reversing trigger can be positioned either between two sector stops mounted on the bushing assembly or above the plane of the two sector stops to allow 360° of rotation of the sprinkler body.

A further feature of the present invention is a multiple position diffuser and deflector lever. The lever is pivotably mounted on one side of the sprinkler body so as to be movable into and out of a stream of water projecting from the sprinkler body. A diffuser/deflector plate laterally projects from an arm of the lever. A triangular projection located radially outwardly from a deflector plate initially encounters the projected stream of water from the sprinkler body upon downward rotation of the lever about a fixed pivot. In a first series of positions, as controlled by biased engagement of the lever with a projection extending from the sprinkler body, the triangular projection contacts the outer periphery of a stream of projected water so as to disrupt the surface tension of the water and disperse a portion of the stream of the water into fine droplets having a radial projection less than the remaining portion of the non-disrupted stream. Upon continued downward rotation of the lever, the deflector plate interrupts the stream of projected water so as to cause the entire stream of water to be redirected according to the angle of incidence between the deflector plate and the stream of water.

Another feature of the present invention includes a split tip terminal end of the sprinkler body which is compressed for insertion into and through the bushing assembly. Upon passage through the passage assembly, the compression of the tip of the sprinkler body is released and the sections of the split tip terminal end spread out radially and extend behind the bushing assembly so as to secure the bushing assembly on the sprinkler body.

Located along a shaft of the sprinkler body which extends through the bushing assembly are two spaced pairs of radially extending rings. Each pair of rings defines an annular space therebetween for receipt of an 0-ring. The resilient 0-ring radially seals the space between the shaft of the sprinkler body and the bushing assembly, even in the absence of water from a water source, so as to prevent passage of water into the space between the shaft and bushing assembly when water from a water source is delivered to the sprinkler.

As an alternate embodiment to the traditional impact arm having two longitudinally extending parallel plates which are connected by two separated vanes, an impact arm may be provided which has a single longitudinally extending plate with two separated vanes projecting downwardly from the plate. The two vanes have free ends which are spaced from the plate and which together taper downwardly.

It is therefore an object of the present invention to provide a pulsating sprinkler having a sprinkler body rotatably mounted in a bushing assembly with a one-piece position-controlling mechanism for operating an impact drive pulsating sprinkler between a forward-drive position and a reverse-drive position, and in a continuous rotation position.

It is another object of the present invention to provide such a sprinkler having a single piece diffuser and deflector lever which controls the amount of diffusion or deflection of a projected stream of water by frictional engagement between the lever and sprinkler body in a series of spaced positions.

It is yet another object of the present invention to provide such a sprinkler which includes at least one radially extending O-ring located between a shaft of the sprinkler body and a bushing assembly for sealing against water flow.

It is still yet another object to provide such a sprinkler in which the impact arm includes either two parallel, longitudinally extending plates having curved vanes between the plates for water dispersion or a single longitudinally extending plate having two separate vanes projecting downwardly from the single plate.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
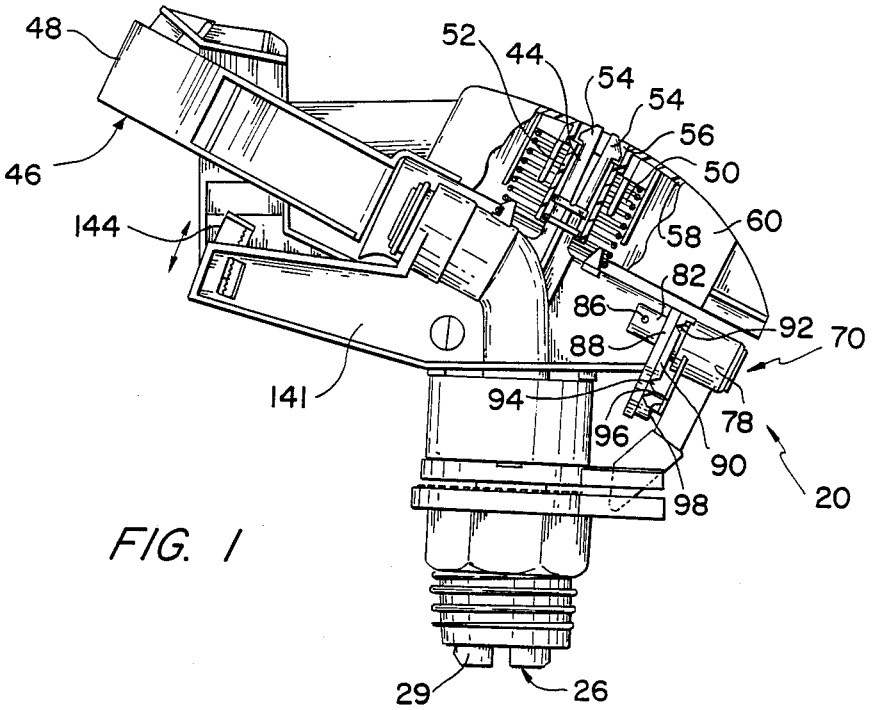
FIG. 1 is a partial sectional, side elevation view of a pulsating sprinkler according to the present invention with a trigger in a partial circle orientation.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, a full or part-circle step-by-step pulsating sprinkler embodying the teachings of the subject invention is generally designated as 20. The sprinkler 20 includes a sprinkler body 22, with a hollow tubular shaft 24 having a fluid passage which begins at the lower end 26 of the sprinkler body and extends upwardly therethrough along a vertical axis and then upwardly and outwardly through an outlet nozzle 28 of the sprinkler body.

Figure 4:
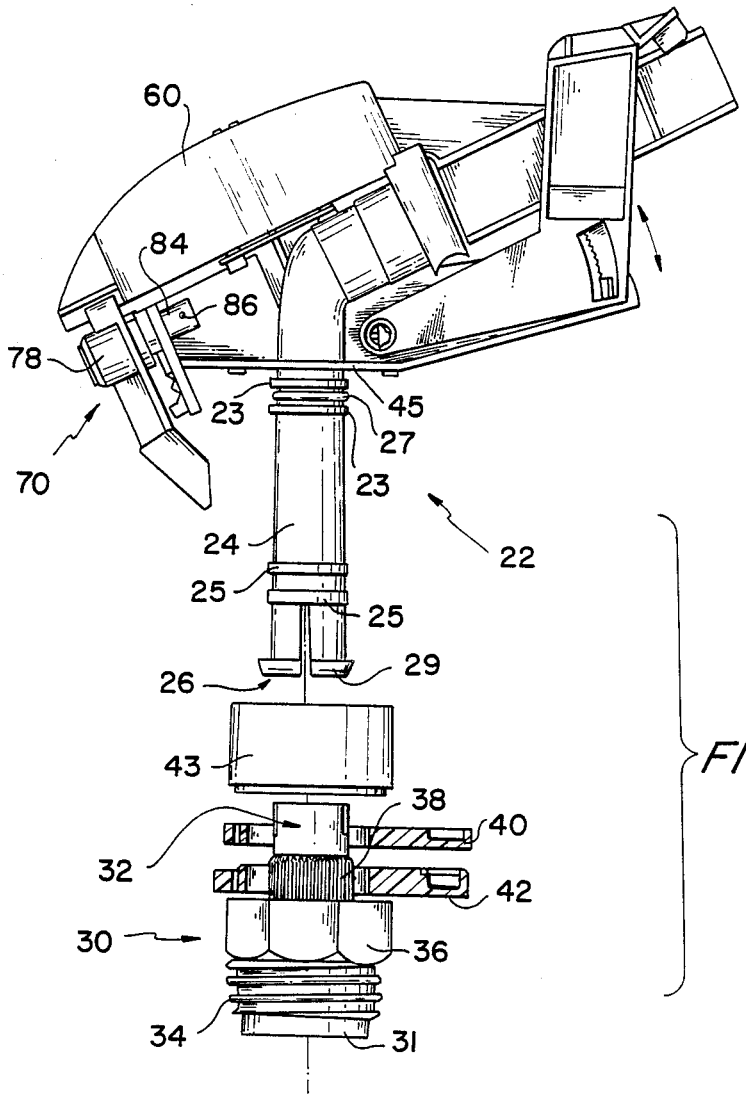
FIG. 4 is an exploded, partial sectional view of the sprinkler.

A bushing assembly 30 is mounted for rotational movement about the vertical axis of the shaft 24. The bushing assembly 30 includes a bushing member 32 having an externally threaded lower portion 34, an intermediate portion 36 of nut-like appearance, and an upper portion 38 having radially outwardly projecting vertically extended ridges thereon. The bushing assembly also includes a pair of vertically aligned upper and lower sector stops 40 and 42. Spacer 43 is normally integral with sector stop 40. In FIG. 4, spacer 43 is shown as being separate from sector stop 40 for illustrative purposes only.

The externally threaded lower portion 34 of the bushing assembly 30 is adapted for connection with a fluid source such as an internally threaded sprinkler base (not shown). When the bushing member 32 and the fluid sources are in threaded engagement, the sprinkler body 22 is supported by the bushing assembly 30 for rotational movement about a vertical axis. When a fluid source delivers water under pressure to the inlet 26 of the fluid passageway, the water under pressure flows upwardly through the sprinkler body 22 and then upwardly and outwardly through the outlet nozzle 28. It will be noted that the outlet nozzle 28 has an essentially longitudinal axis which passes through the axis of rotation of the sprinkler body 22, the axis of rotation of the sprinkler body and the central longitudinal axis of the outlet intersecting at an angle of approximately 65 degrees.

Figure 2:
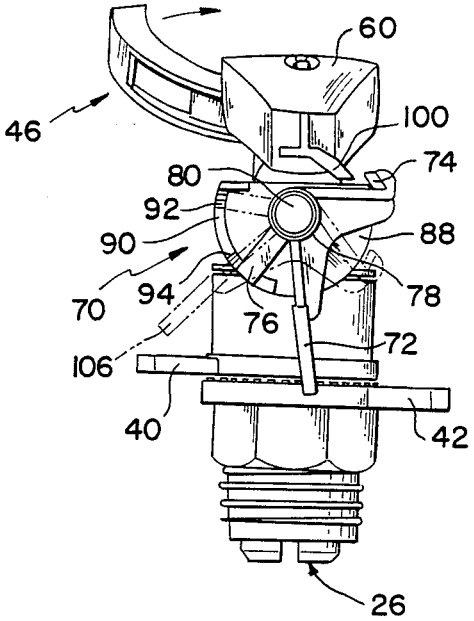
FIG. 2 is a rear elevation view of the sprinkler.
Figure 3:
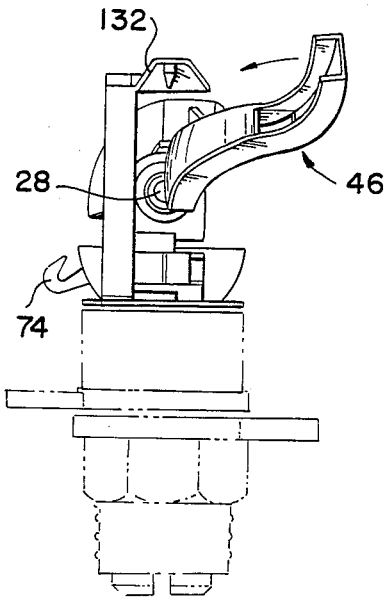
FIG. 3 is a front elevation view of the sprinkler.

A split shaft 44, having an axis aligned substantially perpendicular to the axis of the outlet nozzle 28, extends from the sprinkler body 22. Mounted on the split shaft 44, for oscillatory pivotal movement, is an impact arm 46. At one end of the impact arm 46 is a drive spoon 48. The impact arm 46 is normally biased into an impact limiting position as shown in FIGS. 1 and 2, wherein the portions of the impact arm 46, adjacent the sprinkler body 22, engage the sprinkler body as a stop. The bias is provided by a torsion spring 50 surrounding a middle portion of the split shaft 44 and having one end secured to the sprinkler body and the other end thereof secured to the impact arm 46. In FIG. 3, the impact arm is moved slightly from the impact limiting position so as to illustrate the outlet nozzle 28.

The drive spoon 48 is adapted to be engaged by a fluid stream when it is in its impact limiting position and to impart a rotary movement to the impact arm 46, by virtue of the reaction of the water on the spoon, in a direction to move the spoon away from the stream. As the arm rotates in a direction to move the spoon away from the stream, spring 50 normally retards its movement until it is completely stopped and resiliently biased thereby to move in the opposite direction, back to the impact limiting position. In this way, as the arm 46 rotates under the action of the spring 50 and moves into its impact limiting position, the sprinkler body 22 is impacted, causing the sprinkler body 22 to move about its vertical, pivotal axis. Thus, in accordance with usual practice, the impact arm 46 and its drive spoon 48 will normally effect a step-by-step rotational movement of the sprinkler body in one direction.

In order to minimize or preclude backsplash or secondary spray, the drive spoon 48 may be constructed according to anti-backlash principles of the type well known in the art and exemplified by U.S. Pat. No. 3,022,012; U.S. Pat. No. 3,977,610 and U.S. Pat. No. 4,164,324.

The split tip shaft 44 is secured to the impact arm 46 by passage through a cylindrical opening defined by side walls 52, with the free ends 54 of the split tip shaft, extending into an enlarged area 56, recessed from a top surface 58 of a head 60 of the impact arm. The split portions 54 of the shaft are resilient so as to be biased radially outwardly from the side walls 52 so as to prevent removal of the head 60 from the shaft 44. The impact arm 46 is thus pivotally mounted on the shaft 44.

Shaft 24 includes two pairs of radially extending rings 23 and 25, which define between each set of rings an annular space for receipt of an O-ring. In FIG. 4, O-ring 27 is shown. However, O-ring 27 may be located between rings 25 or two O-rings may be located between rings 23 and between rings 25. Upon sliding of the shaft 24 into bushing member 32, the O-ring 27 seals the clearance between the shaft 24 and the bushing member 32.

Upon passage of the lower end 26 of the sprinkler body through the bushing member 32, the split tip ends 29 of the shaft 24 are radially biased to pass beyond the innermost edge of the lowermost end 31 of the bushing member 32 so as to project beyond the inner-most edge of the bushing member 32 and hold the sprinkler body 22 rotatably mounted within the bushing member 32.

The sprinkler 20 is provided with a reversing or trip mechanism, generally indicated by the numeral 70, which is adapted to cooperate with the impact arm 46 and sector stops 40, 42. The trip mechanism 70 includes a trigger 72, and a latch 74 for engaging the impact arm 46 before it has an opportunity to substantially wind up the torsion spring 50 by substantial movement away from the impact limiting position, and a control arm 76, integrally connected with a cylindrical hub 78 as are trigger 72 and latch 74, so that a predetermined movement of the trigger results in a predetermined movement or tripping of the latch 74.

The hub 78 is integral with and interconnects the trigger 72, latch 74 and control arm 76, and is rotatably mounted about a shaft 80. In FIG. 1, the hub 78 includes two lateral projections 82 and 84, located on opposite sides of the sprinkler body, which are interconnected by a pin 86, which projects through the two projections 82, 84, for securing the hub and therefore the trigger 72, latch 74 and control arm 76 on the sprinkler body. It is envisioned that alternate means may be used for rotatably mounting the hub on the sprinkler body such as designing the shaft 80 to pass through the hub and providing the shaft 80 with biased ends which spring radially outwardly to lock behind the hub or by forcing excess material of the shaft 80 radially outwardly after positioning of the hub 78, on the shaft, so that the hub is locked on the shaft in a rotatably mounted position.

The trip mechanism includes a truncated, circular plate 88, with shaft 80 projecting axially from a center of the plate, so that an axis of the hub 78 is coincident with the axis of the plate. Extending perpendicular to and along the periphery of the plate 88, is a ridge 90. Ridge 90 is provided with a first detent 92, a second detent 94 which is spaced circumferentially from the first detent 92, and a third detent 96 which is located adjacent to the second detent 94. The control arm 76 includes a perpendicular projection 98 which extends towards ridge 90. Ridge 90 is biased by the elasticity of the control arm 76 to be frictionally held in each of the detents 92, 94 and 96.

Figure 5:
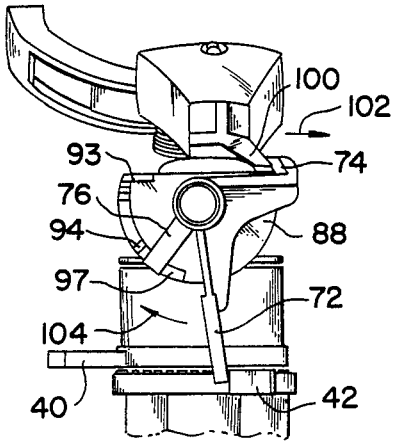
FIG. 5 is a rear elevation view of a trip mechanism in a partial circle orientation.

As shown in solid lines in FIG. 2 and in FIG. 5, projection 98 is engaged in the third detent 96. In this position, the latch 74 is elevated into the plane of angled extension 100 mounted on the head 60 of the impact arm. The latch will therefore engage with the extension 100 to cause reversing movement of the impact arm. Stops 93 and 97 are provided on circular plate 88 to limit further movement of the projection 98 beyond detents 92 or 96.

Movement of the latch 74 into and out of the plane of the extension of 100 is caused by engagement or disengagement of the trigger 72 with the sector stops 40, 42. The sector stops are positioned to define between them a sector of coverage of water from the sprinkler as is explained in U.S. Pat. No. 4,497,441, incorporated herein by reference. The sector stops are manually rotated about the bushing assembly and held in position to define between them an area of coverage for water spray. The sprinkler is activated by initiation of water passage from an external source.

The trigger 72 is manually movable between a limited sector sprinkle position in which the projection 98 of the control arm 76 is located in third detent 96, as shown in FIGS. 2 and 5. In FIG. 5, the latch 74 engages the extension 100 to cause the sprinkler to be driven in the direction of arrow 102. As the sprinkler moves in the direction of arrow 102, the trigger 72 engages with sector stop 42. Continued rotation of the sprinkler causes the trigger 72 to be moved in the direction of arrow 104 so as to move the trigger 72 to the position shown in FIG. 6 with the projection 98, of the control arm 76, being located in the detent 94, and the latch 74 having moved out of the rotational plane of the extension 100 to allow the impact arm to drive the sprinkler body in a forward rotational direction.

Figure 6:
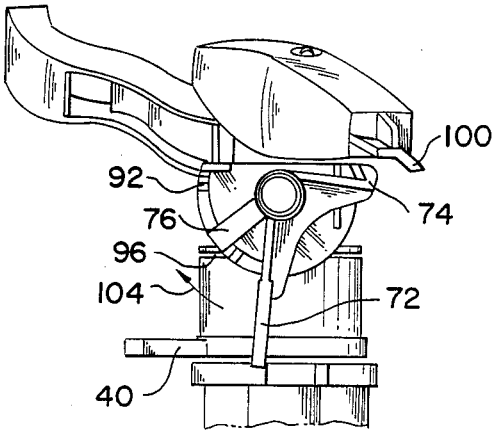
FIG. 6 is a rear elevation view of the trip mechanism in a different partial circle orientation.

The sprinkler body continues to rotate with the trigger 72 in a limited sector sprinkle position located in the planes of both of the sector stops 40, 42. When the trigger 72 moves into contact with the sector stop 40, the trip mechanism 70 is moved into a position which causes the latch 74 to pivot upwardly so that latch 74 intercepts and limits the outward movement of the impact arm 46 by engagement with extension 100. The sprinkler body then begins a rapid, step-by-step rotary movement in the opposite direction until the sprinkler body reaches a second predetermined position of rotational movement determined by the position of the other sector stop 42, wherein the trip mechanism is moved back into its first operating position with the latch 74 pivoted downwardly to a non-intercepting orientation as shown in FIG. 6.

For a continuous rotation of the sprinkler body, the trigger 72 is manually moved so that the trigger is spaced above the operative planes of both of the sector stops 40, 42 to preclude tripping engagement therewith. Projection 98 of the control arm 76 is then located in detent 92. In this position 106, shown in phantom lines in FIG. 2, the trigger 72 passes over the planes of the sector stops 40, 42 during continuous rotation of the sprinkler body.

In an alternate embodiment, for the trip mechanism, it is possible to maintain the position of the projection 98 by engagement with a smooth surfaced plate. The bias of the arm 76 is sufficient to hold the projection 98 in place during full or part-circle rotation of the sprinkler body.

Figure 12:
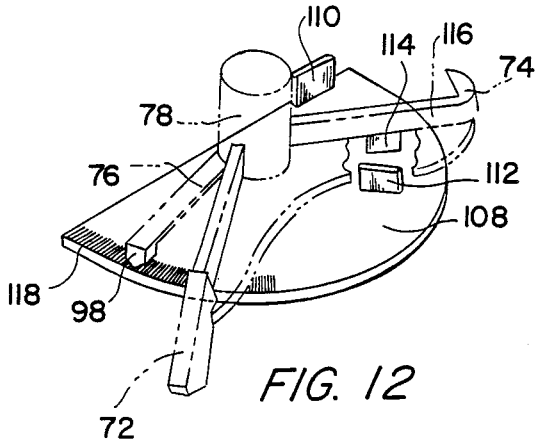
FIG. 12 is an alternate embodiment of the trip mechanism.

In yet another embodiment, as shown in FIG. 12, similar parts are labeled by the same reference numbers used in the description of FIGS. 1 through 6. Plate 108 is of a similar peripheral shape to that of plate 88. Plate 108 includes two perpendicular extending stops 110 and 112, which cooperate with a projection 114 extending downwardly from arm 116 of the latch 74. In addition, the projection 98 of control arm 76 is biased to frictionally engage, in the example in FIG. 12, a series of ridges 118 extending radially inward from a peripheral edge of the plate 108. Alternately, any type of frictional surface may be substituted for ridges 118 as long as the minimum resistive movement of the projection 98 is caused by movement of the trigger 72 sufficient to hold the projection 98 in position. The trigger 72 is maintained in a stationary position by a minimal frictional force if no external force is being applied to the trigger 72. Thus, the application of some predetermined amount of force is required to move the trigger 72 across the frictional surface.

Identical movement of the trigger 72 between the planes of sector stops 40 and 42 or out of the planes of sector stops 40 and 42, as used for continuous or forward and reverse movement within a defined sector for the sprinkler body, is accomplished by the frictional engagement of the projection 98 with the plate 108 instead of the use of three detents in a raised ridge of plate 88 as shown in FIGS. 1 to 6. The stops 110, 112 serve to prevent over-extension of manual movement of the trigger 72, which may be accomplished in the absence of such stops.

The sprinkler optionally further includes a diffuser and deflector mechanism 120, having a lever arm 122, with one end 124 of lever arm 122 pivotably mounted on the sprinkler body by a biased pin 126, passing through a circular bore 128. An opposite free end 130, of the arm 122, includes a diffuser and deflector member 132, which extends laterally from end 130. The member 132 has a triangular shaped extension 134 which projects from a plate 136, and a second plate 138 which extends at an obtuse angle with respect to plate 136.

An adjustment mechanism 140 includes an arm 141 of the sprinkler body, with a fixed indicator 142, located within a channel 144 of arm 141. Along a ridge of channel 144 are a series of ridges 146, which extend in an arcuate manner along a wall 148 defining a portion of channel 144. The indicator 142 is biased to engage with the ridges 146 so as to limit the pivotal movement of the lever arm 122 for movement of the member 132 into and out of a path defined by a stream of water projected from outlet nozzle opening 28.

Figure 7:
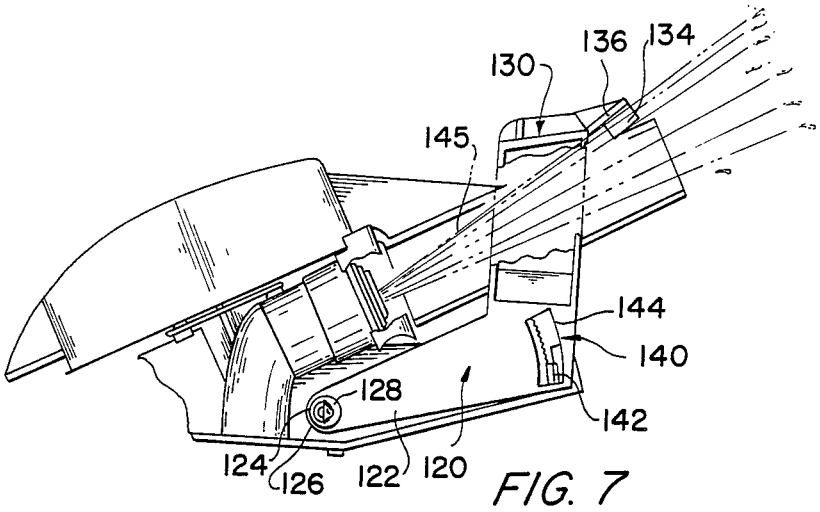
FIG. 7 is a side elevation view of a diffuser projection interposed in a stream of water.
Figure 8:
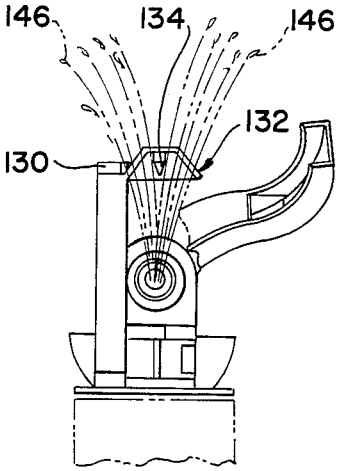
FIG. 8 is a front elevation view of a stream of water contacting a diffuser projection to form fine water droplets.

Typically, the number of ridges 146 are ten, however, it is only important that a bias from the indicator 142 acts on the lever arm 122 to maintain the position of the lever with respect to the outlet nozzle 28. The lever arm 122 is held in position by the bias of the indicator 142 along the ridges 146, as shown in FIGS. 7 and 8. In the first few positions, the triangular projection 134 engages a peripheral surface of a stream of water from outlet nozzle 28 so as to disrupt the stream of water and break the water into droplets 146 rather than a concentrated stream of water.

Figure 9:
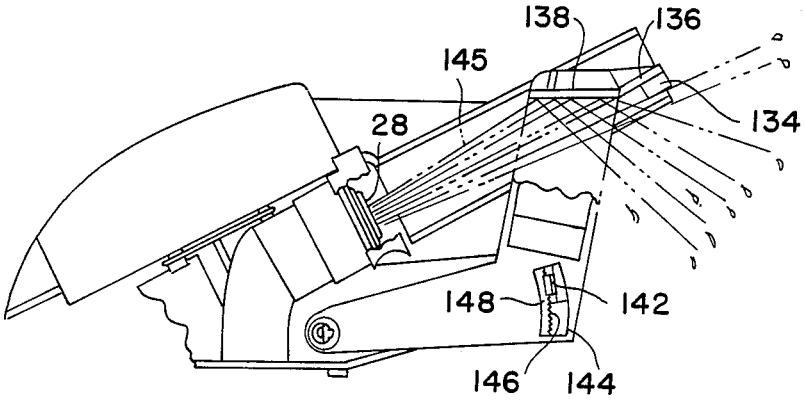
FIG. 9 is a side elevation view of a stream of water contacting a deflection plate.

Upon continued downward movement of the lever arm 122 by sliding the indicator 142 over ridges 146, the stream of water 145 encounters deflection plate 138, as shown in FIG. 9, to divert the direction of the stream of water 145, at an angle with respect to its original path of travel.

Figure 10:
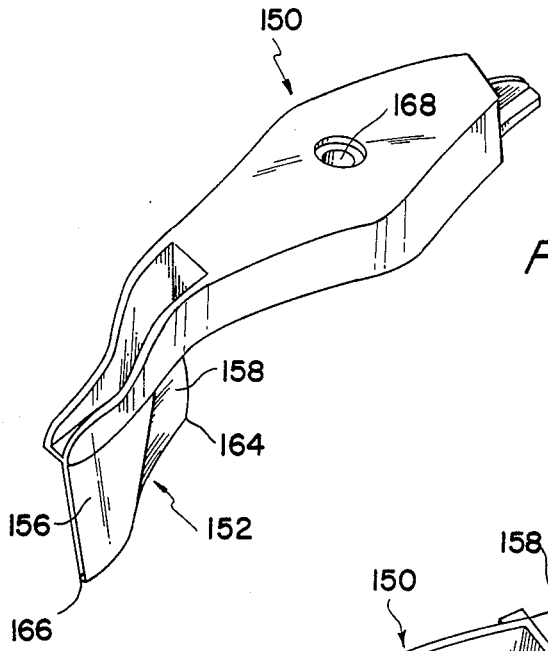
FIGS. 10 and 11 illustrate an alternate embodiment impact arm.
Figure 11:
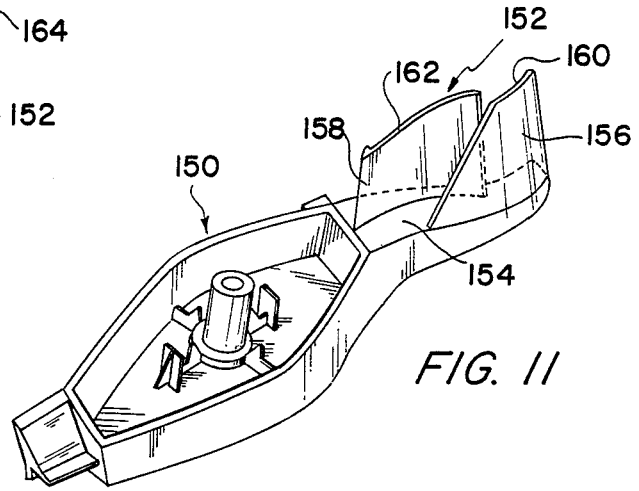

In FIGS. 10 and 11, an alternate embodiment of an impact arm 150 is shown having a drive spoon 152, including a substantially flat plate 154 with two downwardly projecting vanes 156 and 158. The two vanes are separated from each other and have free ends 160 and 162, respectively, which taper downwardly in the position shown in FIG. 10 from a rearmost corner 164 of edge 162 of vane 158, to a lowermost position at corner 166 of edge 160 of vane 156.

Similar to the impact arm shown in FIGS. 1 through 9, the impact arm 150 includes a bore 168 for receipt of a split prong shaft 44 as shown in FIG. 1. The overall length of the impact arm 150 compared to impact arm 46, is substantially less so that a corresponding reduction in length of the lever arm 122 is required to compensate for the reduced length of the impact arm 150 and so that hitting the impact arm 150 avoids hitting against the lever arm 122 as the impact arm returns to a position interrupting the flow of the stream of water.

Operation of the sprinkler is essentially conventional in nature, with the threaded end of the bushing assembly 30 being operatively connected to a fluid sources, normally through a sprinkler base. The lever arm 122 is set for a controlled amount of diffusion by projection 134 or deflection by deflection plate 138 to provide the desired degree of diffusion or deflection of the emitted spray.

When the sprinkler is to be operated in a full circle mode, the trigger is moved until it extends above the plane of the sector stops 40, 42. If the sprinkler is to be operated on a partial circle mode, the trigger 72 is lowered until it is aligned in the plane between the sector stops 40, 42.

The sprinkler is preferably formed entirely of plastic, with the exception of the torsion spring 50. The principles of the present invention are, however, also directly applicable to a sprinkler formed primarily of metal.

To summarize, the present invention provides a pulsating sprinkler incorporating a three-position trip mechanism facilitating forward/reverse rotation and continuous rotation. A multiple position diffuser and deflector lever is adjustable for various degrees of diffusion or deflection of a water stream. The sprinkler body is easily removed from the bushing assembly by compression of snap fingers located at a terminal end of the spring body. Further, an O-ring radially seals a space between the bushing assembly and the sprinkler body. Either an impact arm having two plates with separated vanes extending between the plates or an impact arm with a single plate with two downwardly projecting vanes may be used for ease in molding and increasing manufacturing efficiency.

Now that the preferred embodiments of the present invention have been shown and described in detail, various modifications and improvements thereon will become readily apparent to those skilled in the art. Accordingly, the spirit and scope of the present invention is to be limited only by the appended claims, and not by the foregoing specification.

I claim:

1. A step-by-step sprinkler capable of full or part-circle operation, said sprinkler comprising:

a bushing assembly adapted for connection to a fluid source, a sprinkler body mounted on said bushing assembly and being rotatable relative thereto in either direction, an impact arm mounted on said sprinkler body for driving the rotation of said sprinkler body, trip means pivotally mounted on said sprinkler body for reversing the direction of rotation of said sprinkler body when tripped, spaced adjustable sector stops mounted on said bushing assembly for respective engagement with said trip means and for defining limits of a part circle operation of the sprinkler, said trip means including trigger means movable (1) between said sector stops for engagement with respective sector stops so as to reverse direction of rotation of said sprinkler body upon contact with said sector stops and (2) being movable to a position located spaced from planes defined by said sector stops for continuous circular rotation of said sprinkler body, latch means engageable with said impact arm for limiting rotation of said impact arm so that a direction of rotation of said sprinkler body is reversed when said trigger means is located between said sector stops, and control means engagable with said sprinkler body for maintaining said trigger means in a fixed position until said trigger means is manually moved or moved by engagement with respective sector stops to a different position at which said control means maintains the different position, said trigger means, said latch means and said control means being joined to a common pivot mounted on said sprinkler body for simultaneous movement of said trigger means, said latch means and said control means.

2. A step-by-step sprinkler as claimed in claim 1, wherein said sector stops are axially fixed and rotatably mounted on said bushing assembly.

3. A step-by-step sprinkler as claimed in claim 1, wherein said trigger means, said latch means, and said control means are mounted on a common hub, said hub being pivotally mounted on said sprinkler body.

4. A step-by-step sprinkler as claimed in claim 1, wherein said control means includes a spring arm having a projection biased by said spring arm to engage a portion of said sprinkler body.

5. A step-by-step sprinkler as claimed in claim 4, wherein said portion of said sprinkler body includes a circular plate having a peripheral edge including means for holding said projection in a fixed position by the bias of said spring arm until said spring arm is driven by a predetermined amount of force.

6. A step-by-step sprinkler as claimed in claim 5, wherein said means for holding includes a plurality of detents.

7. A step-by-step sprinkler as claimed in claim 6, wherein two of said detents are for engagement with said projection during forward and reverse directions of movement of said sprinkler body and a third detent for engagement with said projection during continuous circular movement of said sprinkler body.

8. A step-by-step sprinkler as claimed in claim 5, wherein said means for holding includes a roughened surface.

9. A step-by-step sprinkler as claimed in claim 5, wherein said means for holding includes a plurality of ridges.

10. A step-by-step sprinkler as claimed in claim 1, wherein said impact arm includes a longitudinally extending plate having two separated vanes extending from said plate and said two vanes each having a free end.

11. A step-by-step sprinkler as claimed in claim 10, wherein said free end of each of said two vanes tapers in a radially outward direction and increasing in height as said free ends extend radially outward.

12. A step-by-step sprinkler as claimed in claim 1, further comprising a combined diffuser and deflector member extending from one end of a lever for selectively diffusing or deflecting a stream of water emanating from said nozzle body, said lever being pivotally mounted at an opposite end of said lever on said body for pivotal movement through a single plane in a plurality of fixed positions in an arc of rotation so that at some of said plurality of fixed positions of said lever in the plane in the arc of rotation, the stream of water is diffused and at other of said plurality of fixed positions in the plane in the arc of rotation, the stream of water is deflected.

13. A step-by-step sprinkler as claimed in claim 1, wherein said sprinkler body includes at least one radially extending sealing means for sealing a space between said sprinkler body and said bushing assembly.

14. A pulsating sprinkler comprising:

a bushing assembly adapted for connection to a fluid source, a sprinkler body mounted on said bushing assembly and being rotatable relative thereto in either direction and defining a passage for flow of water, a nozzle outlet defined by said sprinkler body for passage of a stream of water, means for rotating said sprinkler body including an impact arm mounted on said sprinkler body and having a drive spoon in the stream of water for interrupting the stream of water emanating from said nozzle outlet to form a pulsating stream of water and for causing an impact to said sprinkler body rotating said sprinkler by a portion of said impact arm impacting said sprinkler body or a member affixed to said sprinkler body, and a diffuser and deflector means extending laterally from one end of a lever, said lever being pivotally mounted at an opposite end of said lever on said body for pivotal movement through a single plane in a plurality of fixed positions in an arc of rotation so that at some of said plurality of fixed positions of said lever in the plane in the arc of rotation, the stream of water is diffused and at other of said plurality of fixed positions in the plane in the arc of rotation, the stream of water is deflected.

15. A pulsating sprinkler as claimed in claim 14, wherein said diffuser and deflector means includes a diffuser projection mounted on a diffuser plate and said diffuser plate is mounted on a deflection plate at an angle to said diffuser plate.

* * * * *